United States Patent [19]

Lubitz

[11] Patent Number: 4,842,057

[45] Date of Patent: Jun. 27, 1989

[54] RETRIEVABLE GRAVEL PACKER AND RETRIEVING TOOL

[75] Inventor: Eric P. Lubitz, Duncan, Okla.

[73] Assignee: Halliburton Company, Duncan, Okla.

[21] Appl. No.: 213,203

[22] Filed: Jun. 29, 1988

[51] Int. Cl.[4] ..... E21B 33/128; E21B 33/129; E21B 43/04

[52] U.S. Cl. ..... 166/51; 166/120; 166/123; 166/128; 166/278

[58] Field of Search ..... 166/51, 278, 120, 122, 166/123, 131, 133, 144, 150, 152, 278, 212, 138, 128

[56] References Cited

U.S. PATENT DOCUMENTS

| | | | |
|---|---|---|---|
| 4,049,055 | 9/1977 | Brown | 166/123 X |
| 4,078,606 | 3/1978 | Montgomery | 166/138 X |
| 4,401,158 | 8/1983 | Spencer et al. | 166/51 |
| 4,418,754 | 12/1983 | Stepp | 166/278 |
| 4,493,374 | 1/1985 | Magee, Jr. | 166/382 |
| 4,583,593 | 4/1986 | Zunkel et al. | 166/382 |
| 4,611,658 | 9/1986 | Salerni et al. | 166/138 X |
| 4,627,488 | 12/1986 | Szarka | 166/51 |
| 4,627,491 | 12/1986 | Zunkel | 166/126 |
| 4,628,993 | 12/1986 | Zunkel | 166/51 |
| 4,633,943 | 1/1987 | Zunkel | 166/51 |
| 4,633,944 | 1/1987 | Zunkel et al. | 166/51 |
| 4,635,716 | 1/1987 | Zunkel | 166/51 |
| 4,638,860 | 1/1987 | Magee, Jr. et al. | 166/114 |
| 4,662,453 | 5/1987 | Erisco | 166/387 |
| 4,664,188 | 5/1987 | Zunkel et al. | 166/134 |
| 4,671,352 | 6/1987 | Magee, Jr. et al. | 166/186 |

OTHER PUBLICATIONS

Halliburton Services Sales & Service Catalog, No. 43, 1985, pp. 2523–2529.

Arrow Oil Tools, "Arrowdrill Seal Bore Packer", Tulsa, OK, 1 page.

Pengo DHL Production Packer, 1 page.

Brown Type 1B Permanent Packer, 1 page.

Vann Systems Catalog, pp. B-30 and B-31, Publication Date Unknown.

*Primary Examiner*—Stephen J. Novosad

*Attorney, Agent, or Firm*—James R. Duzan; Neal R. Kennedy

[57] ABSTRACT

A retrievable gravel packer and retrieving tool therefor. The gravel packer includes an inner mandrel assembly attached to an operating tool by a left-hand threaded connection. The packer is set without rotation by the operating tool to move a pusher sleeve downwardly with respect to the mandrel, compressing a packer element and setting slips into engagement with a well bore. A ratchet prevents the pusher sleeve assembly from moving upwardly with respect to the mandrel. The packer may be retrieved by the retrieving tool which has a lower collet engagable with a releasing mandrel in the packer. After releasing collets held by the releasing mandrel, the inner mandrel of the packer is released so that the packer element and slips engaged by the mandrel are disengaged from the well bore. An upper collet in the retrieving tool engages the left-hand thread in the packer mandrel so that the packer and retrieving tool may be raised out of the well bore. If the packer becomes jammed and cannot be retrieved in this manner, the retrieving tool may be further raised so that the lower collet in the retrieving tool is released from the releasing mandrel in the packer. The packer includes antirotation pins so that it can be easily milled out of the well bore.

20 Claims, 5 Drawing Sheets

RETRIEVABLE GRAVEL PACKER AND RETRIEVING TOOL

BACKGROUND OF THE INVENTION

1. Field Of The Invention

This invention relates to gravel packers, and more particularly, to a retrievable gravel packer set without rotation and to a retrieving tool therefor.

2. Description Of The Prior Art

When gravel packing a well it is desirable to minimize the number of trips downhole to operate or install tools and perform the gravel packing operation. One ideal method would be to make one trip downhole to set a sump or false bottom packer, then make one more run to set a gravel packer, perform a gravel packing operation, and remove the tool string and operating tool out of the well, leaving the gravel packer ready for production. Another desirable feature would be to enable gravel packing multiple zones within the well bore. Also, in deviated wells or in situations where the packer is set on bottom, it is desirable that the gravel packing operation be carried out without rotation of the tool string. Further, it is desirable to be able to retrieve the gravel packer when desired, or at least be able to mill the packer out of the well bore.

One retrievable gravel packer which meets these characteristics is disclosed in U.S. Pat. No. 4,664,188 to Zunkel et al., assigned to the assignee of the present invention. The packer in this patent has an inner mandrel with an expandable packing means thereon and a slip assembly positioned below the packing means. A setting tool engages a threaded portion in the mandrel and applies a downward force on an upper shoe means for compressing the packing means for sealing engagement with the well bore and for setting the slip means into gripping engagement with the well bore. Locking means such as a plurality of individual locking dogs grippingly engage an outer surface of the mandrel for preventing relative upper movement of the upper shoe means. A releasing means is provided for releasing the mandrel when desired so that the packing means and slips are disengaged for retrieval of the gravel packer.

The gravel packer of the present invention includes a ratchet means for preventing upward movement of a pusher sleeve with respect to a mandrel and has relatively thin wall thicknesses which makes it well adapted for use in relatively small well bores while still allowing adequate flow therethrough. Also, the gravel packer of the present inveniion includes port means which allows flow through an upper portion thereof when circulation operations are being carried out by an operating tool.

In the above-referenced patent to Zunkel et al., a retrieving tool is disclosed having an upper collet for engaging the threaded portion of the mandrel in the packer and a spring biased lower mandrel for engaging the releasing piston. The retrieving tool of the present invention comprises upper collet means slidably disposed on a collet support means which is further slidable with respect to a mandrel. This insures proper alignment of the upper mandrel collet means with the threaded portion in the mandrel means. The retrieving tool of the present invention also has a lower mandrel means which is not spring biased, but is free to slide on a lower portion of the mandrel means. This lower collet means may be engaged with a releasing mandrel and locked therewith for releasing and retrieving the packer.

Further, by additional manipulation of the mandrel means in the retrieving tool, the lower collet means may be disengaged from the releasing piston in the event that the packer becomes jammed. In this way, the retrieving tool may still be removed from the packer, and then the packer may be milled out of the well bore because the packer includes anti-rotation means for its components.

SUMMARY OF THE INVENTION

The gravel packer of the present invention comprises packer mandrel means for connecting to an operating tool, sealing means disposed around the packer mandrel means for sealingly engaging a well bore when in a set position, slip means disposed around the packer mandrel means for grippingly engaging the well bore when in a set position, and sleeve means disposed around the packer mandrel means and slidable therewith for actuating the sealing means and the slip means into the set positions thereof. The slip means comprises a slip housing, an upper slip wedge adjacent to the slip housing and slidably engaged with the packer mandrel means, a lower slip wedge adjacent to the slip housing and slidable therewith, and a plurality of slips disposed in the slip housing and engagable with the upper and lower slip wedges. The packer further comprises a means on the packer mandrel means for engaging the upper slip wedge whereby the upper slip wedge may be moved away from the slips during a retrieving operation and means on the upper slip wedge for engaging the slip housing during the retrieving operation after the packer mandrel means engages the upper slip wedge.

The upper slip wedge preferably is an upper slip wedge assembly including the upper slip wedge connected to a lower shoe. The means on the packer mandrel means for engaging the upper slip wedge is preferably characterized by an upwardly facing shoulder on the packer mandrel means which engages a downwardly facing shoulder in the lower shoe. The means on the upper slip wedge for engaging the slip housing is preferably characterized by a shoulder on the upper slip wedge which extends into a slot defined in the slip housing and is adapted for engaging an upper end of the slip housing during the retrieving operation.

The packer also preferably comprises port means through the packer mandrel means and the sleeve means for providing fluid communication between a central opening defined through the packer mandrel means and a well annulus, defined between the sleeve means and a portion of the well bore above the sealing means, regardless of the relative position of the packer mandrel means and the sleeve means. This port means thus provides fluid communication between a flow passage in the operating tool during a circulating operation wherein a gravel slurry is packed around the packer adjacent to a well formation.

The packer also comprises means for allowing downward movement only of the sleeve means with respect to the packer mandrel means and preventing relative upward movement thereof prior to the retrieving operation. This means for allowing relative downward movement is preferably characterized by a ratchet means comprising a threaded, first ratcheted surface on the sleeve means, a second ratcheted surface on the packer mandrel means, and a ratchet ring having a threaded ratcheted outer surface and an inner ratcheted surface for ratcheting engagement with the first and second ratcheting surfaces, respectively. Means are preferably provided for preventing relative movement between the ratchet ring and the sleeve means.

In order that the gravel packer may be milled out of the well bore, the preferred embodiment of the packer comprises means for preventing relative rotation of the sleeve means and the slip means with respect to the packer mandrel means. This anti-rotation means preferably comprises a pin extending from one of the sleeve means and the packer mandrel means into a slot defined in the other of the sleeve means and the packer mandrel means, and at least one pin extending from one of the slip means and the packer mandrel means into a longitudinal slot defined in the other of the slip means and the packer mandrel means.

The means for preventing relative rotation between the slip means and the packer mandrel means comprises a pin extending from one of the upper slip wedge and the packer mandrel means into a longitudinal slot defined in the other of the upper slip wedge and the packer mandrel means, and a pin extending from one of the lower slip wedge and the slip housing into a longitudinal slot defined in the other of the lower slip wedge and the slip housing.

The gravel packer further comprises lower mandrel means for connecting to a lower tool string portion and means for connecting the lower mandrel means to the packer mandrel means. This means for connecting may be characterized by collet means and releasing means for disengaging the collet means and thereby releasing the packer mandrel means from the lower mandrel means.

The packer may further comprise means for gauging a size of the well bore and preventing damage to the sealing means and the slip means as the packer is lowered into the well bore. The gauging means may be characterized by a gauge ring attached to the lower mandrel means.

The gravel packer may form a portion of a gravel packing system including, in addition to the packer, an operating tool attachable to a tool string and having an actuating portion for engaging the sleeve means and a threaded portion for engaging the threaded portion in the packer mandrel means. The operating tool defines first and second flow passages therein. The port means in the packer is in communication with the first flow passage when the operating tool is in a circulating position. The system further comprises a ported sub attached to the packer and in communication with the second flow passage when the operating tool is in a run-in position, and a screen assembly attached to the ported sub. All motion required to set the packer and operate the tool string during the circulating operations is vertical.

The gravel packer is retrievable, and the retrieving tool of the present invention comprises retrieving mandrel means for attaching to a tool string, collet support means for supporting a collet means and slidably disposed on the retrieving mandrel means, upper collet means for engaging the threaded portion in the packer mandrel means and slidably disposed on the collet support means, and lower collet means for engaging the releasing means in the packer.

Preferably, the retrieving tool further comprises means for preventing relative rotation between the retrieving mandrel means and the collet support means. In one embodiment, one of the retrieving mandrel means and the collet support means defines a longitudinal slot therein, and the other of the retrieving mandrel means and the collet support means has a lug extending therefrom and engaging the slot. Shoulder means are also provided for defining a downwardmost position for the collet support means with respect to the mandrel means.

The collet support means preferably comprises a collet retainer and a collet support extending from the collet retainer. The collet support has an outer surface with an enlarged lower portion extending radially outwardly therefrom. The upper collet means is preferably characterized by an upper collet comprising a plurality of collet fingers extending downwardly from a ring portion. The ring portion is slidably disposed around the outer surface of the collet support between a first position wherein the fingers are free to flex radially inwardly toward the outer surface for engaging the threaded portion of the packer mandrel means and a second position after raising of the retrieving mandrel means wherein the collet fingers are prevented from flexing radially inwardly by the enlarged lower portion of the collet support.

The retrieving mandrel means comprises an outer surface and an enlarged portion extending radially outwardly from the outer surface. The lower collet means is characterized by a lower collet having a plurality of collet fingers extending downwardly from a ring portion. The ring portion of the lower collet is slidably disposed on the outer surface of the retrieving mandrel means between a first position wherein the fingers are free to flex radially inwardly toward the outer surface when engaging the releasing means of the packer and a second position, after raising of the retrieving mandrel means, wherein the fingers of the lower collet are prevented from flexing radially inwardly by the enlarged portion of the retrieving mandrel means. Stop means are provided for holding the lower collet in the second position when the retrieving mandrel means is raised. The retrieving tool further comprises shearing means for shearably attaching the stop means to the retrieving mandrel means and for shearing in response to a predetermined upward force applied to the retrieving mandrel means. The retrieving mandrel means may thereby be further raised with respect to the lower collet means such that the lower collet is in a third position wherein the fingers are again free to flex radially inwardly for disengaging from the releasing means of the packer. In the first position of the lower collet means, the lower collet means is above the enlarged portion of the retrieving mandrel means. In the second position, a portion of the lower collet means is positioned radially outwardly of the enlarged portion of the retrieving mandrel means, and in the third position, said portion of the lower collet means is below the enlarged portion of the retrieving mandrel means.

When it is desired to retrieve the gravel packer, the retrieving tool is positioned therein such that the upper collet means engages the threaded portion of the packer mandrel means, and the lower collet means engages the releasing means in the packer. Raising the tool string releases the releasing means such that the packer mandrel means may be raised, whereby the sealing means and slip means of the packer are released from the engagement with the well bore. Further raising of the tool string lifts the retrieving tool and the packer from the well bore because of the engagement of the upper collet means with the threaded portion in the packer mandrel means.

Should the packer become jammed, the shear means holding the stop means on the lower collet means is sheared such that the lower collet means is released from the releasing means. Because of the left-hand threaded connection between the upper collet means and the threaded portion of the packer mandrel means, the tool string may be rotated to the right so that the retrieving tool is removed from the packer. The packer may then be milled out of the well bore. The means for preventing relative rotation of the components allows such a milling operation.

An important object of the invention is to provide a gravel packer which may be set without rotation of the tool string.

Another object of the invention is to provide a gravel packer which may be retrieved on a retrieving tool.

Still another object of the invention is to provide a retrieving tool for a gravel packer.

A further object of the invention is to provide a gravel packer, with a relatively large inside diameter, usable in relatively small well bores.

An additional object of the invention is to provide a gravel packer with means for preventing relative rotation of its components so that the packer may be milled out if necessary.

Another object of the invention is to provide a system for setting and retrieving gravel packers at one or more locations in a well bore.

Additional objects and advantages of the invention will become apparent as the following detailed description of the preferred embodiment is read in conjunction with the drawings which illustrate such preferred embodiment.

DESCRIPTION OF THE PREFERRED EMBODIMENT

Figure 1A:
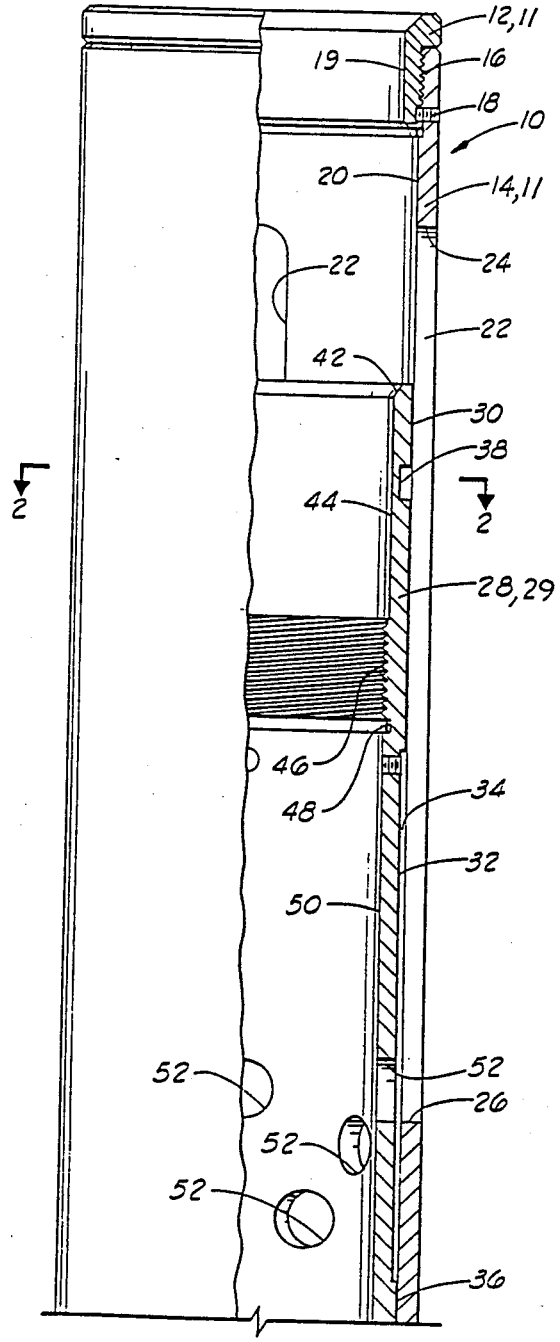
FIGS. 1A–1C show a longitudinal cross section of the retrievable gravel packer of the present invention.
Figure 1B:
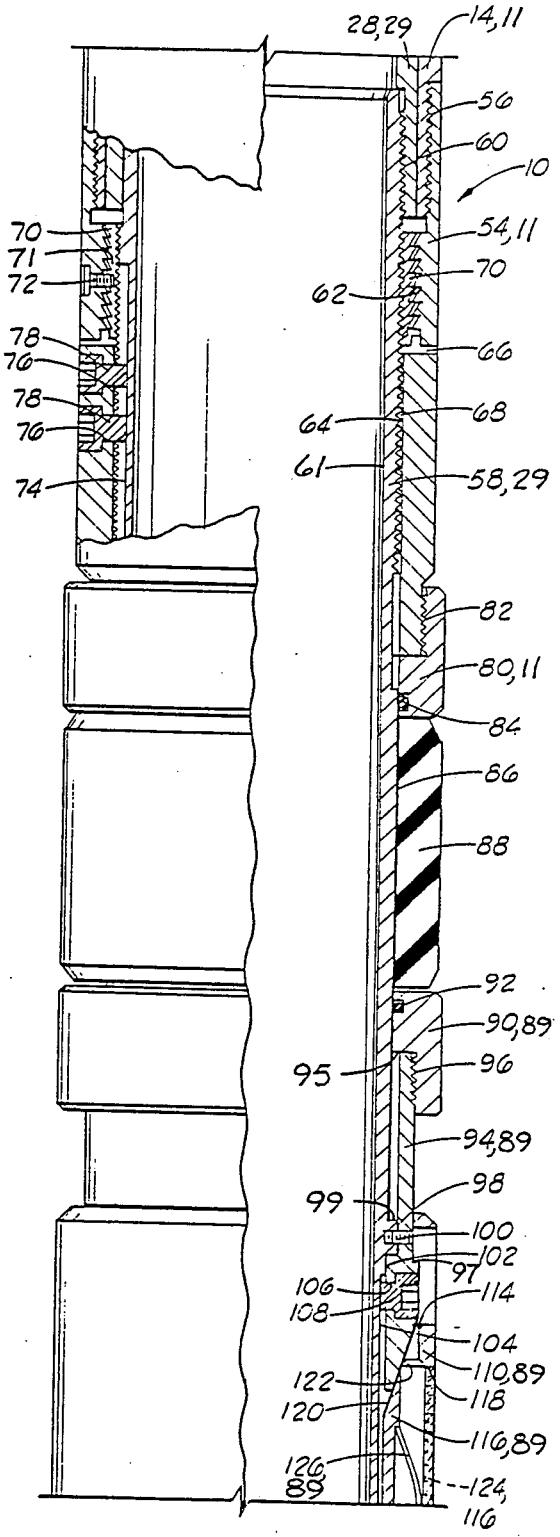
Figure 1C:
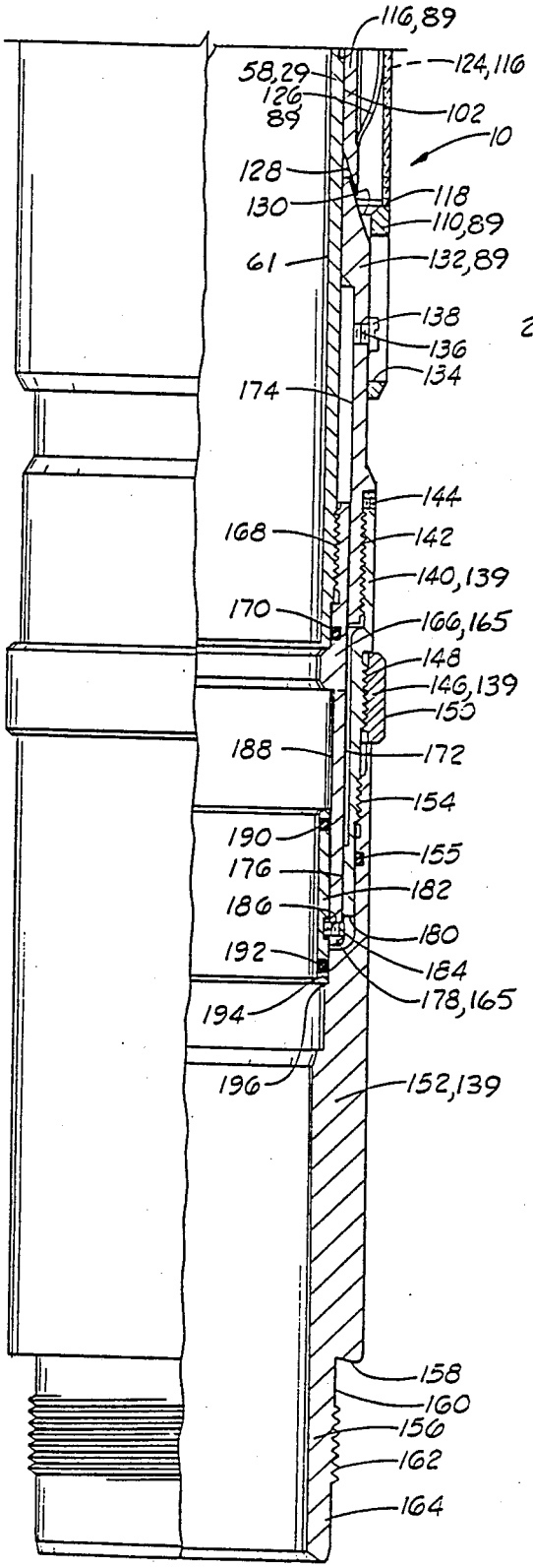

Referring now to the drawings, and more particularly to FIGS. 1A–1C, the retrievable gravel packer of the present invention is shown and generally designated by the numeral 10. Details of the operation of packer 10 and its interaction with an operating tool and the retrieving tool will be further discussed herein.

At the upper end of gravel packer 10 is a pusher sleeve means 11 comprising top end cap 12 engaged with pusher sleeve 14 at threaded connection 16. At least one set screw 18 locks top end cap 12 and pusher sleeve 14 together. Top end cap 12 defines a central bore 19 therethrough.

Pusher sleeve 14 defines a central bore 20 therethrough in communication with bore 19 in top end cap 12. A plurality of longitudinally extending slots are defined through pusher sleeve 14, and slots 22 will be seen to be in communication with bore 20. Each slot 22 has an upper end 24 and a lower end 26.

Slidably disposed in bore 20 of pusher sleeve 14 is a top sub 28, which forms an upper portion of a packer mandrel means 29, which may be characterized as an inner mandrel assembly 29. Top sub 28 has a first outside diameter 30 which is in close, spaced relationship to bore 20 of pusher sleeve 14, a second outside diameter 32 which is spaced radially inwardly from first outside diameter 28 such that an annular volume 34 is defined between pusher sleeve 14 and top sub 28, and a third outside diameter 36 which is substantially the same diameter as first outside diameter 30.

Figure 2:
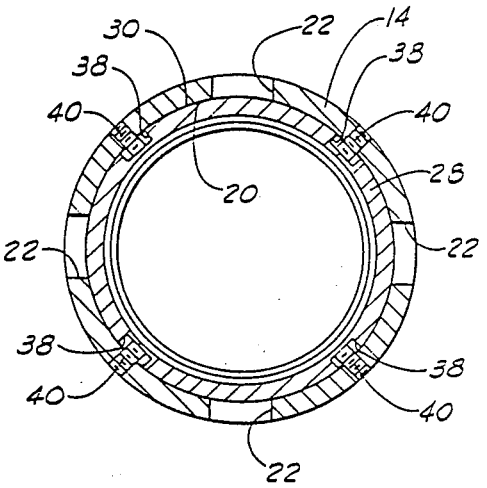
FIG. 2 a cross section taken along lines 2—2 in FIG. 1A.

A plurality of recesses 38 are defined in first outside diameter 30 of top sub 28. Referring also to FIG. 2, it will be seen that four such recesses 38 are angularly spaced about a central axis of gravel packer 10, and are thus angularly positioned between slots 22. While four slots 22 and four recesses 38 have been shown for the purposes of this disclosure, it should be understood that the actual number may vary. Further, although a recess 38 is shown in FIG. 1A for illustration purposes, a study of FIG. 2 will show that the recess is actually angularly displaced approximately 45° from the slot 22 shown in FIG. 1A. A plurality of shear pins 40 are threaded into pusher sleeve 14, such that each shear pin 40 extends into a corresponding recess 38. Thus, shear means are provided for holding packer mandrel means 29 in the relative position with pusher sleeve means 11 as shown in FIGS. 1A and 1B.

On the inside of top sub 28 is an upwardly facing chamfer 42 at the upper end of a first bore 44. Below first bore 44 is a left-hand threaded portion 46 with an annular groove 48 therebelow. Extending downwardly from groove 48 is a second bore 50. Extending through second bore 50 are a plurality of transverse holes 52, at least one of which is substantially longitudinally aligned with a slot 22 in pusher sleeve 14 adjacent lower end 26 of the slot. Annular volume 34 insures communication between holes 52 and slots 26 even if the holes and slots are not angularly aligned about a central axis of gravel packer 10. Thus, a port means is provided between packer mandrel means 29 and a well bore in which packer 10 is positioned.

Referring now to FIG. 1B, the lower end of pusher sleeve 14 is connected to ratchet ring housing 54 at threaded connection 56. At substantially the same longitudinal location, the lower end of top sub 28 is connected to inner mandrel 58 at threaded connection 60. It will be seen that ratchet ring housing 54 forms a portion of pusher sleeve means 11, and inner mandrel 58 forms a portion of packer mandrel means 29. Inner mandrel 58 defines a central opening 61 therethrough.

Ratchet ring housing 54 has a threaded, ratcheted inner sleeve surface 62 with a bore 64 extending therebelow. At least one transverse hole 66 extends through ratchet ring housing 54 at a longitudinal location substantially between ratcheted inner surface 62 and bore 64.

Inner mandrel 58 has a ratcheted outer mandrel surface 68 thereon. It will be seen that at least a portion of ratcheted outer surface 68 on inner mandrel 58 faces ratcheted inner surface 62 in ratchet ring housing 54. An annular ratchet or lock ring 70 is disposed between inner mandrel 58 and ratchet ring housing 54, such that it is in threaded, ratcheted engagement with ratcheted inner surface 62 and in ratcheted engagement with outer surface 68. Ratchet ring 70 defines a longitudinal slot 71 therein. A bind head screw 72 extends through ratchet ring housing 54 and into slot 71 to provide a means for preventing relative rotation between ratchet ring 70 and ratchet ring housing 54.

Inner mandrel 58 defines a longitudinally extending slot 74 thereon which extends radially inwardly from ratcheted outer surface 68. Adjacent to slot 74, ratchet ring housing 54 defines a pair of transverse holes 76 therethrough. Extending through each hole 76 into slot 74 is a pin 78. Preferably, pins 78 are the form of a socket head cap screw. It will be seen by those skilled in the art that the interaction of pins 78 with slot 74 provides a means for preventing relative rotation of ratchet ring housing 54 and inner mandrel 58, and thus provides a means for preventing relative rotation between packer mandrel means 29 and pusher sleeve means 11. However, pins 78 are sized such that they are slidable within slot 74 so that relative longitudinal movement between ratchet ring housing 54 and inner mandrel 58 is possible, as further described herein.

The lower end of ratchet ring housing 54 is connected to an upper packing backup shoe 80, also referred to as upper shoe 80, at threaded connection 82. Sealing means, such as O-ring 84, provides sealing engagement between upper shoe 80 and a second outside diameter 86 of inner mandrel 58. Upper packing backup shoe 80 forms a lower portion or end of pusher sleeve means 11.

Annularly positioned around second outside diameter 86 of inner mandrel 58, and sealingly engaged therewith is a packer or sealing means, such as packer sleeve or element 88 for sealingly engaging a well bore. Packer element 88 is made of an elastomeric material known in the art.

Disposed below packer element 88 is a slip means 89 for grippingly engaging the well bore. Slip means 89 comprises a lower packing backup shoe 90, also referred to as lower shoe 90. Sealing means, such as O-ring 92, provide sealing engagement between lower shoe 90 and second outside diameter 86 of inner mandrel 58.

Lower shoe 90 has a downwardly facing shoulder 95 therein and is attached to upper slip wedge 94 at threaded connection 96. Upper slip wedge 94 also forms a portion of slip means 89. Upper slip wedge 94 and lower packing backup shoe 90 may also be referred to as an upper slip wedge assembly. Upper slip wedge 94 has an upwardly facing shoulder 97 thereon. Upper slip wedge 94 is initially connected to inner mandrel 58 at a third outside diameter 98 thereof by a shear pin 100. An upwardly facing shoulder 99 extends between second outside diameter 86 and third outside diameter 98. As will become more clear in a reading of the discussion on the retrieval of packer 10, shoulder 99 provides a means on packer mandrel means 29 for engaging the upper slip wedge assembly during a retrieving operation, and shoulder 97 on upper slip wedge 94 provides a means on the upper slip wedge for engaging slip housing 110 during the retrieving operation after packer mandrel means 29 engages the upper slip wedge assembly.

Below shear pin 100, inner mandrel 58 has a fourth outside diameter 102 defining a longitudinally extending slot 104 therein. Upper slip wedge 94 defines a transverse hole 106 therein, and a pin 108 extends through hole 106 into slot 104. Pin 108 is preferably a socket head cap screw sized to be slidable within slot 104 such that relative longitudinal movement between upper slip wedge 94 and inner mandrel 58 is possible, as hereinafter described. However, the engagement of pin 108 with slot 104 will be seen to provide a means for preventing relative rotational movement between slip wedge 94 and inner mandrel 58, and thus a means for preventing relative rotation between slip means 89 and packer mandrel means 29.

Upper slip wedge 94 extends into slip housing 110. Slip housing 110, which is also a portion of slip means 89, has an upper slot 114 therein which allows installation of pin 108 and shear pin 100.

A plurality of slips 116 also form part of slip means 89 and are positioned in corresponding openings 118 in slip housing 110. Slips 116 define an upper, inner wedge surface 120 which engage outer wedge surface 122 on upper slip wedge 94. The radially outer portion of each slip 116 defines a knurled surface, forming a plurality of gripping teeth 124 thereon. Teeth 124 are adapted for grippingly contacting an inner surface of the well bore, as hereinafter described. Biasing means, such as a plurality of springs 126, bias slips 116 radially inwardly and form another portion of slip means 89.

Referring now to FIG. 1C, the lower end of slips 116 define a lower, inner wedge surface 128 which engages an outer wedge surface 130 on a lower slip wedge 132. Lower slip wedge 132 forms a lower portion of slip means 89.

Slip housing 110 defines a lower slot 134 therein adjacent the lower end of the slip housing. A pin, preferably in the form of a cap screw, is threadingly engaged with lower slip wedge 132 adjacent to slot 134. Lower slip wedge 132 and pin 136 may be characterized as a lower slip wedge assembly. Pin 136 has a head portion 138 which extends into slot 134 and is slidable therein. However, the engagement of head portion 138 of pin 136 with slot 134 provides a means for preventing relative rotation between slip housing 110 and lower slip wedge 132.

The lower end of lower slip wedge 132 is connected to a lower mandrel means 139 including a generally annular connector 140 at threaded connection 142. A set screw 144 prevents mutual rotation between lower slip wedge 132 and connector 140.

An annular guide ring 146 is attached to the outer surface of connector 140 at threaded connection 148 and forms a portion of lower mandrel means 139. Guide ring 146 has an outside diameter 150 which represents the maximum diameter of any of the components of gravel packer 10. Thus, as gravel packer 10 is lowered into a well bore, if there is an undersized portion of the well bore or any obstructions therein, these will first be contacted by guide ring 146. Thus, guide ring 146 provides gauging means for gauging the well bore and preventing an undersized well bore or obstructions in the well bore from damaging slip means 89 or packer element 88.

The lower end of connector 140 is attached to lower sealing mandrel 152 at threaded connection 154. Lower sealing mandrel 152 is the main component of lower mandrel means 139. Sealing means, such as O-ring 155, provides sealing engagement between lower sealing mandrel 152 and connector 140.

A lower end 156 of lower sealing mandrel 152 has a downwardly and outwardly tapered shoulder 158, a first outside diameter 160, an externally threaded surface 162, and a second outside diameter 164.

The lower end of inner mandrel 58, and thus a lower portion of packer mandrel means 29, is connected to collet means 165 including a collet body 166 at threaded connection 168. Sealing means, such as O-ring 170, provides sealing engagement between collet body 166 and inner mandrel 58. Collet body 166 has an outside diameter 172 which is slidably disposed within bore 174 of lower slip wedge 132 and bore 176 of connector 140.

At the lower end of collet body 166 are a plurality of collet fingers 178 which are held into engagement with lower shoulder 180 on connector 140 by a releasing means, such as releasing mandrel 182. A shear pin 184 extends through at least one collet finger 178 and engages a groove 186 in releasing mandrel 182. Thus, shearing means are provided for initially holding releasing mandrel 182 in the position shown in FIG. 1C.

Releasing mandrel 182 is slidably disposed in bore 188 of collet body 166. Sealing means, such as O-ring 190, provides sealing engagement between releasing mandrel 182 and collet body 166. Similarly, sealing means, such as O-ring 192, provides initial sealing engagement between releasing mandrel 182 and bore 194 in lower sealing mandrel 152. Releasing mandrel 182 has a downwardly facing shoulder 196 at the lower end thereof.

Referring now to FIGS. 3A–3D, the retrieving tool used to retrieve gravel packer 10 is shown and generally designated by the numeral 200.

Figure 3A:
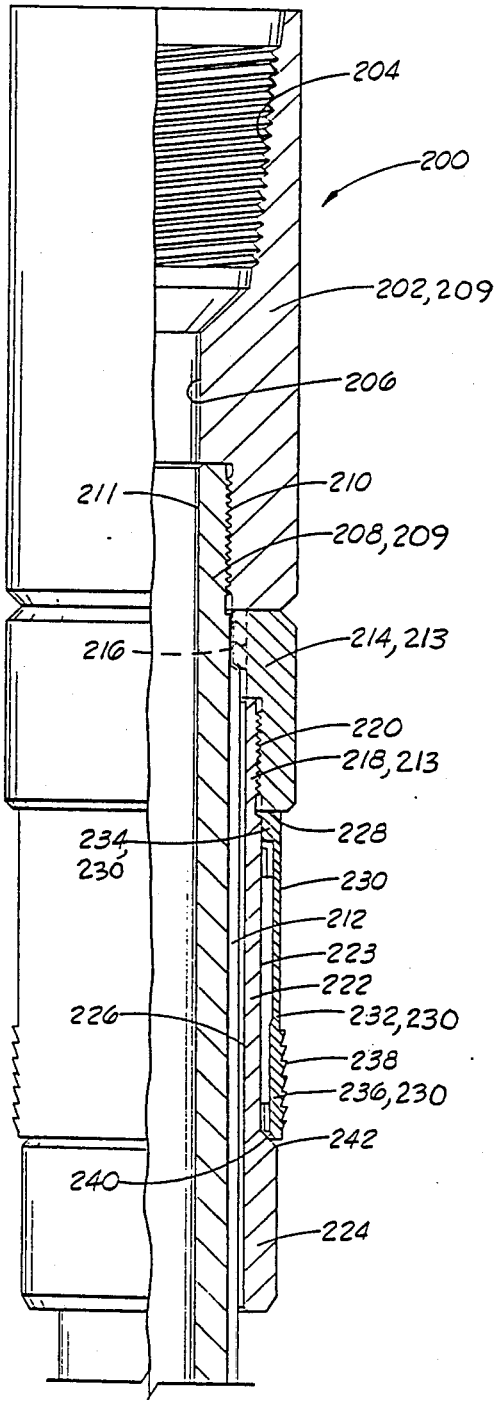
FIGS. 3A–3D show a longitudinal cross section of a retrieving tool for the packer.

As seen in FIG. 3A, at the upper end of retrieving tool 200 is a top coupling 202 having an internal threaded portion 204. Threaded portion 204 is adapted for connection to a tool string (not shown) used to manipulate retrieving tool 200. Top coupling 202 defines a central bore 206 therethrough.

The lower end of top coupling 202 is attached to an elongated spline mandrel 208 at threaded connection 210. Top coupling 202 and spline mandrel 208 each form a portion of a retrieving mandrel means 209.

Figure 3B:
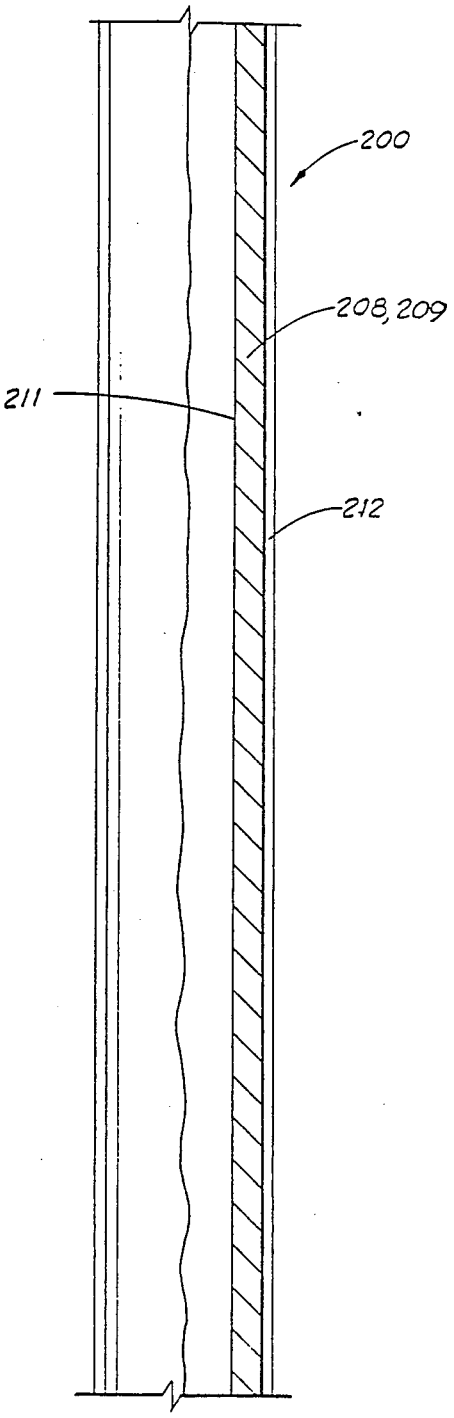
Figure 3C:
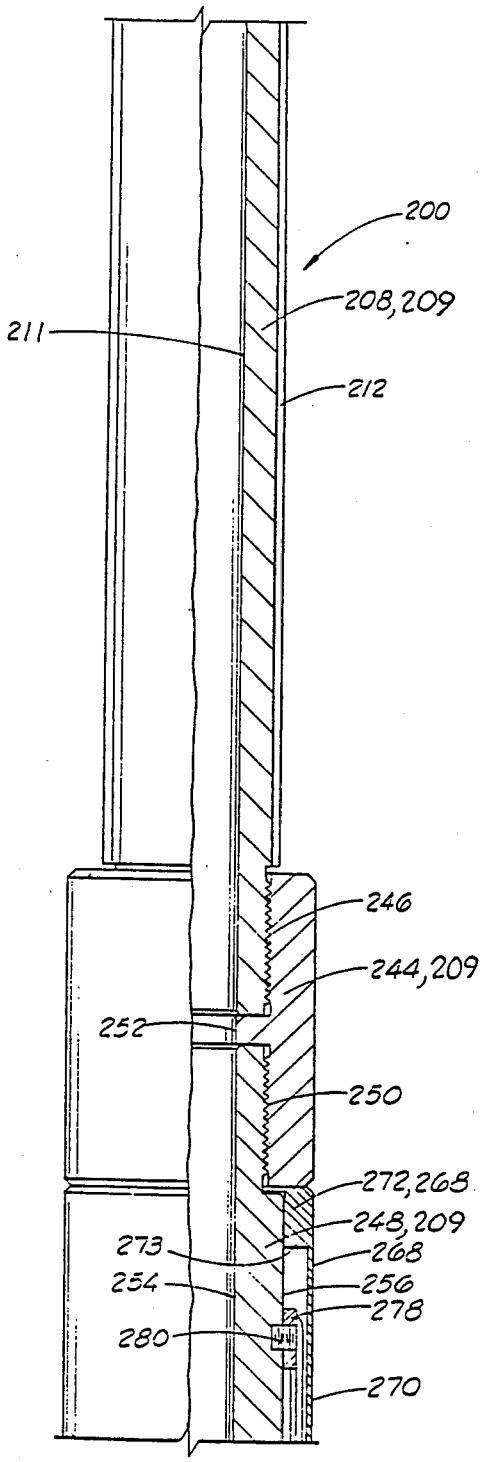

Spline mandrel 208 defines a bore 211 therethrough and has a plurality of longitudinally extending external slots or splines 12 extending most of the length thereof as shown in FIGS. 3A–3C.

Referring again to FIG. 3A, a slidable collet support means 213 is disposed below top coupling 202 of retrieving mandrel means 211. The upper end of collet support means 213 is formed by a collet retainer 214. Collet retainer 214 has an internal lug or spline portion 216 at the upper end which engages spline 212 on spline mandrel 208. It will be seen by those skilled in the art that collet retainer 214 is thus longitudinally slidable with respect to spline mandrel 208, but a means is provided for preventing relative rotation between collet support means 213 and retrieving mandrel means 209.

Collet retainer 214 is attached to the upper end of a collet support 218 at threaded connection 220. Collet support 218 forms a lower portion of collet support means 213 and has a substantially cylindrical intermediate portion 222, with an outside diameter or surface 223, and an enlarged, lower portion 224 below intermediate portion 222. Lower portion 224 extends radially outwardly from intermediate portion 222. Collet support 218 defines a central bore 226 therethrough which is spaced radially outwardly from splines 212 on spline mandrel 208.

Annularly disposed around intermediate portion 222 of collet support 218, and longitudinally positioned between lower shoulder 228 of collet retainer 214 and enlarged portion 224 of collet support 218, is a first or upper collet means, characterized by an upper collet 230 having a plurality of longitudinally extending collet fingers 232 extendingddownwardly from an annular ring portion 234. Ring portion 234 is adapted for sliding engagement with outside diameter 223 of intermediate portion 222 of collet support 218.

The lower end of collet fingers 232 include an enlarged portion 236 defining an external, left-hand threaded surface 238 thereon. At the lower end of enlarged portion 236 is an internally chamfered surface 240 which generally faces chamfered surface 242 at the upper end of enlarged lower portion 224 of collet support 218.

Referring now to FIG. 3C, the lower end of spline mandrel 208 is connected to a center coupling 244 at threaded connection 246. Center coupling 244 is in turn connected to a lower collet retainer 248 at threaded connection 250. Center coupling 244 and lower collet retainer 248 form a lower end of retrieving mandrel means 209. Center coupling 244 defines a bore 252 therethrough, and lower collet retainer 248 defines a central bore 254 therethrough. Bores 252 and 254 are substantially the same diameter as central bore 211 in spline mandrel 208.

Figure 3D:
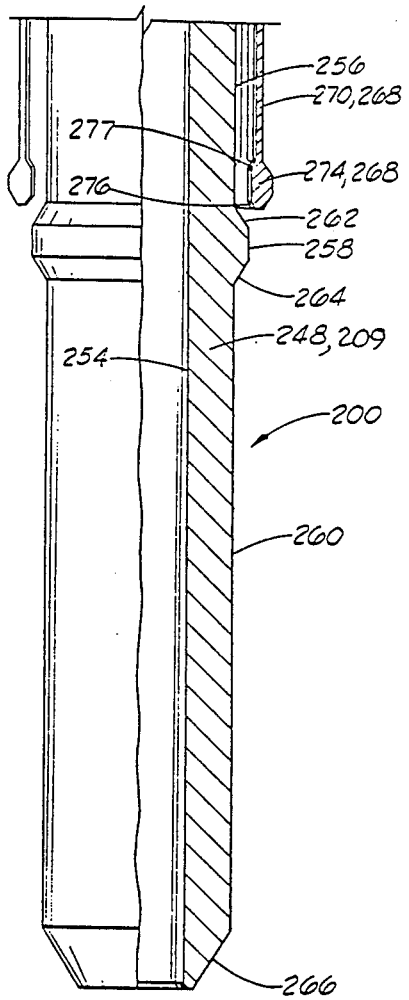

Referring now to FIGS. 3C and 3D, lower collet retainer 248 has a first outside diameter or surface 256, an enlarged portion having second outside diameter 258, and a third outside diameter or surface 260 which is substantially the same size as first outside diameter 256. An upwardly facing chamfered surface 262 interconnects first outside diameter 256 and second outside diameter 258. Similarly, a downwardly facing chamfered surface 264 interconnects second outside diameter 256 and third outside diameter 260. The lowermost end of lower collar retainer 248 has a downwardly facing tapered surface 266 thereon.

Annularly disposed around first outside diameter 256 of lower collet retainer 248 is a second or lower, releasing collet means, characterized by a lower, releasing collet 268 having a plurality of longitudinally extending collet fingers 270 extending downwardly from annular ring portion 272. At the end of each collet finger 270 is an enlarged lower portion 274 having a downwardly facing chamfered surface 276, generally facing chamfered surface 262 on lower collet retainer 248, and an upwardly facing chamfered surface 277. Ring portion 272 of collet 268 is adapted for sliding engagement with first outside diameter 256 of lower collet retainer 248.

Annularly positioned around first outside diameter 256 on lower collet retainer 248 and inside collet fingers 270 on releasing collet 268 is a shear ring 278. Shearing means, such as a shear pin 280, initially holds shear ring 278 on lower collet retainer 248.

OPERATION OF THE INVENTION

Figure 4A:
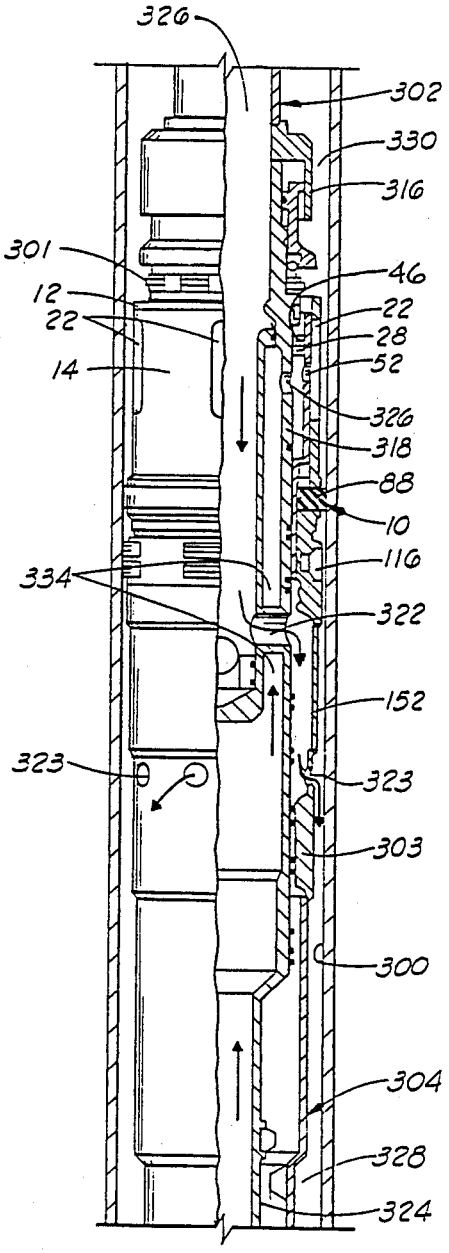
FIGS. 4A and 4B illustrate the gravel packer positioned in a well bore with an operating tool used to set the packer and pack gravel therearound.
Figure 4B:
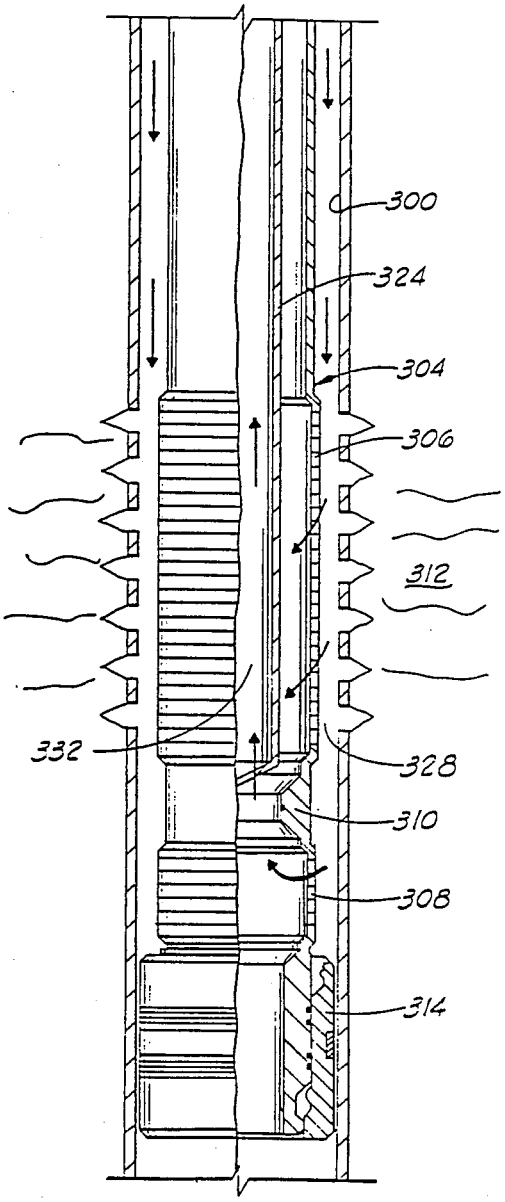

Referring now to FIGS. 1A–1C, and also to FIGS. 4A and 4B, the setting of gravel packer 10 in a well bore 300 will be discussed. Gravel packer 10 is run into well bore 300 on an operating tool 302. A threaded portion 301 on tool 302 is initially engaged in a manner known in the art with lefthand threaded portion 46 in top sub 28 of packer 10. Attached to the lower end of gravel packer 10 on lower sealing mandrel 152 are a ported sub 303 and a screen assembly 304. Screen assembly 304 is of a kind known in the art with a production screen 306 and a telltale screen 308 therebelow. An O-ring sub 310 is positioned between production screen 306 and telltale screen 308.

The entire tool string is lowered into well bore 300 until production screen 306 is substantially adjacent to formation 312. If formation 312 is adjacent to the bottom of well bore 300, screen assembly 304 has a blank end which is simply closed off below telltale screen 308. However, if well bore 300 extends substantially below formation 312, a sump packer 314 of a kind known in the art may be used.

Operating tool 302 is of a kind known in the art, such as that disclosed in U.S. Pat. No. 4,583,593 to Zunkel et al., owned by the assignee of the present invention, and incorporated herein by reference. Generally, operating tool 302 includes a setting piston or actuating portion 316, a ported sub portion 318 defining upper ports 320 and lower, crossover ports 322 therethrough. At the lower end of multi-position tool 302 is a wash pipe 324 which is originally sealingly engaged with O-ring sub 310 in screen assembly 304.

As the entire assembly is lowered into well bore 302, the tool string fills through a flow passage formed by ports 323 in ported sub 303, crossover ports 322 and central opening 326 in multi-position tool 302.

Once packer 10 is in position, actuating portion 316 is hydraulically actuated to begin the setting of gravel packer 10. Actuating portion 316 engages top end cap 12 in gravel packer 10 and forces pusher sleeve 14 downwardly with respect to top sub 28. Ratchet ring 70 moves downwardly over ratcheted outer surface 68 on inner mandrel 58. As this occurs, pins 78 slide downwardly in slot 74 in inner mandrel 58.

As this relative longitudinal motion occurs, packer element 88 starts to compress and sealingly set against well bore 300. As this is occurring, shear pin 100 is sheared so that slips 116 also begin to set. It will be seen that the downward force is transmitted through packer element 88 to lower shoe 90 and thus to upper slip wedge 94. The engagement of wedge surface 122 on upper slip wedge 94 against wedge surface 120 on slips 116 causes the slips to be moved radially outwardly, overcoming the force of springs 126. As slips 116 move outwardly, wedge surface 128 on the slips slides along wedge surface 130 on lower slip wedge 132. Slips 116 are forced outwardly until teeth 124 thereon grippingly engage well bore 300. Further downward force applied by setting piston portion 316 then fully sets packer element 88 into full, sealing engagement with well bore 300.

Packer element 88 cannot unset because the engagement of ratchet ring 70 with ratcheted outer surface 68 on inner mandrel 58 acts as a ratchet means for preventing ratchet ring 70 from moving upwardly, and thus also preventing ratchet ring housing 54 and upper shoe 80 from moving upwardly.

It will be noted that all of the setting operation for gravel packer 10 is carried out by longitudinal, vertical movement. No rotation of the tool string is required in setting the packer. After setting, the well annulus may then be pressurized to test the sealing engagement of packer element 88 with well bore 300.

The tool string is then rotated to the right to back off the engagement of threaded portion 301 of operating tool 302 with left-hand threaded portion 46 in top sub 28.

A circulating operation to transport the gravel slurry to a lower well annulus 328, below packer 10 and between production screen assembly 306 and the portion of well bore 300 adjacent formation 312, may be carried out. First, a lower circulating operation may be performed. In this operation, multi-position tool 302 is raised such that the lower end of wash pipe 324 is adjacent O-ring sub 310, but still sealingly engaged thereby. Upper ports 320 in tool 302 are unsealed and placed in fluid communication with holes 52 in top sub 28 and slots 22 in pusher sleeve 14, and thus, upper ports 320 are in fluid communication with upper well annulus 330 above gravel packer 10. The gravel slurry may be pumped downwardly through central opening 326 in multi-position tool 302, through lower crossover ports 322, ports 323 and into annulus 328. Circulation fluid will pass through telltale sub 308 into central opening 332 in wash pipe 324, around crossover ports 322 and into upper annulus 330 via a flow passage including annular passage 334 in crossover tool 302, upper ports 320, and the port means of holes 52 and slots 22.

After gravel is packed around telltale screen 308, an upper circulating operation may then be carried out. Operating tool 302 is raised so that the lower end of wash pipe 324 is above O-ring sub 310, as shown in FIGS. 4A and 4B, such that wash pipe 324 is no longer sealingly engaged by the O-ring sub. The flow arrows in FIGS. 4A and 4B indicate how additional sand slurry is pumped downwardly through the tool string in a manner somewhat similar to the lower circulating operation. However, now, the circulating fluid passes through production screen 306, rather than telltale spring 308 which has had gravel previously packed around it. The circulating fluid is transported upwardly through operating tool 302 into upper annulus 330 in the manner already described.

After lower annulus 328 has been filled with gravel, operating tool 302 is again lowered such that wash pipe 324 is sealingly engaged with O-ring sub 310 and upper ports 320 are sealingly closed. Fluid may then be pumped downwardly through central opening 326 in operating tool 302 and out crossover ports 322 and ports 323 into lower annulus 328 to squeeze the gravel pack, forcing it into well formation 312.

After the squeezing operation, operating tool 302 is rotated and raised upwardly so that crossover ports 322 are above gravel packer 10. In this position, operating tool 302 is adapted for sealingly closing off the upper end of gravel packer 10. Any gravel and other debris in central opening 326 may be reversed out by pumping cleanout fluid downwardly through annulus 330, into crossover ports 322 and thence transported back to the surface through central opening 326 in operating tool 302. After central opening 326 is thus cleaned, operating tool 302 may be raised out of the well bore with gravel packer 10 left in its operating position. Production may be carried out through gravel packer 10 in a manner generally known in the art.

Retrieving The Gravel Packer

After usage of gravel packer 10, it may be desirable to retrieve it from well bore 300. This is accomplished by running retrieving tool 200 into well bore 300 on the end of a tool string (not shown) of a kind known in the art. Retrieving tool 200 and the tool string fill through the central opening in retrieving mandrel means 209 formed by bore 254 in lower collet retainer 248, bore 252 in center coupling 244, bore 211 in spline mandrel 208 and bore 206 in top coupling 202. As retrieving tool 200 is run into the well bore, collet support means 213 will rest against the upper end of center coupling 244 of retrieving mandrel means 209, because the collet support means is free to slide on spline mandrel 208.

Referring to FIGS. 1A–1C and 3A–3D, retrieving tool 200 is inserted through the center of gravel packer 10. Upper collet 230 is in a first position with respect to collet support means 213 as shown in FIG. 3A, and in this first position, collet fingers 232 on collet 230 may flex inwardly toward outside diameter 223 so that collet fingers 232 engage left-hand threaded portion 46 in top sub 28 of packer 10. Downward movement of retrieving mandrel means 209 brings the lower end of top coupling 202 into engagement with the upper end of collet retainer 214 which is in turn forced into engagement with the upper end of top end cap 12 in packer 10. When this occurs, left-hand threaded surface of collet fingers 238 is in engagement with left-hand threaded portion 46 and top sub 28 of packer 10.

As retrieving mandrel means 209 is moved downwardly, it will slide within collet support means 213 such that releasing collet 268 on retrieving tool 200 engages releasing piston 182 in packer 10. That is, when releasing collet 268 is in a first position shown in FIGS. 3C and 3D, collet fingers 270 flex inwardly toward outside diameter 256, allowing enlarged lower portions 274 of the collet fingers to pass by releasing mandrel piston 182, such that enlarged portions 274 are positioned below releasing mandrel 182 and adjacent to shoulder 196 on the lower end thereof.

To begin the unsetting operation of gravel packer 10, the tool string to which retrieving tool 200 is attached is raised. This raises mandrel means 209 with respect to upper collet 230 and lower releasing collet 268. Because of the engagement between enlarged portion 274 of releasing collet 268 with shoulder 196 on the bottom of releasing mandrel 182, releasing collet 268 is lightly held in place, and lower collet retainer 248 of retrieving mandrel means 209 slides upwardly with respect thereto. This relative longitudinal motion continues until releasing collet 270 is in a second position in which shear ring 278 attached to lower collet retainer 248 by shear pin 280 engages shoulder 273 on ring portion 272 of releasing collet 268. Thus, shear ring and shear pin 280 provide a stop means for initially holding releasing collet 270 in this second position in which it will be seen that enlarged second outside diameter 258 of lower collet retainer 248 is positioned generally radially inwardly of enlarged lower portion 274 of collet fingers 270. Thus, collet fingers 270 are prevented from flexing radially inwardly, and enlarged lower portion 274 is locked into engagement with shoulder 196 on releasing mandrel 182.

Further upward movement of the tool string causes shear pin 184 to be sheared and releasing mandrel 182 is moved upwardly within bore 188 in collet body 166. When this movement of releasing mandrel 182 occurs, it will be seen that collet fingers 178 on collet body 166 are freed such that further upward movement will allow the collet fingers to flex inwardly and pass by shoulder 180 on connector 140. Thus, packer mandrel means 29, to which collet body 166 is attached, is free to be moved upwardly with respect to the outer portion of gravel packer 10.

There is a sight engagement between left-hand threaded portion 238 of collet 230 with left-hand threaded portion 46 of top sub 28 in packer 10 so that the assembly formed by collet retainer 214, collet support 218 and collet 230 is held in place by this threaded engagement. Thus, the upward movement of the tool string hereinbefore described causes spline mandrel 208 in retrieving tool 200 to slide upwardly within collet retainer 214 because of the sliding engagement between spline 212 on spline mandrel 208 and internal spline 216 in collet retainer 214.

Eventually, the lower end of collet support 218 is contacted by the upper end of center coupling 244. The partial threaded engagement between left-hand threaded portion 238 on collet 230 with left-hand threaded portion 46 in top sub 28 holds collet 230 in place. Collet support 218 will slide upwardly within collet 230 such that collet 230 is in a second position in which enlarged lower portion 224 of the collet support is positioned radially inwardly of collet fingers 232, locking the collet fingers radially outwardly so that maximum engagement between left-hand threaded portion 238 and left-hand threaded portion 46 in top sub 28 occurs.

As retrieving mandrel means 209 of retrieving tool 200 and packer mandrel means 29 of packer 10 are moved upwardly, shoulder 99 on inner mandrel 58 engages the shoulder 95 in lower shoe 90, causing upper slip wedge 94 to be moved upwardly with respect to slips 116. Further upward movement then causes shoulder 97 on upper slip wedge 94 to engage the top of upper slot 114 in slip housing 110 so that upper slip wedge 94 and slip housing 110 move upwardly together. The bottom of slip openings 118 in slip housing 110 then engage the lower end of slips 116, pulling the slips upwardly away from lower slip wedge 132. When this upward movement of slips 116 occurs, springs 126 bias slips 116 radially inwardly to their original position, thus engaging the slips from well bore 300.

Also, because of the configuration of ratchet ring 70, the engagement of ratcheted outer surface 68 on inner mandrel 58 will cause ratchet ring 70, and thus ratchet ring housing 54, to be moved upwardly with respect to packer element 88. This upward movement relieves the compression on packer element 88 until the packer element returns to substantially its original configuration and is no longer in engagement with well bore 300.

Once packer element 88 and slips 116 are no longer engaged with well bore 300, it will be seen by those skilled in the art that further upward movement of the tool string holding retrieving tool 200 will simply pull gravel packer 10 upwardly through well bore 300 so that it may be retrieved at the surface.

Should there be a malfunction in the retrieving operation such that one or both of packer element 88 and slips 116 cannot be disengaged from well bore 300, retrieving tool 200 must then be disengaged from packer 10. When such a problem occurs, raising the tool string to which retrieving tool 200 is attached will cause shear pin 280, which holds shear ring 278 to lower collet retainer 248, to be sheared. After shearing pin 280, lower collet retainer 248 of retrieving mandrel means 209 is free to move further relatively upwardly with respect to releasing collet 268. When this occurs, releasing collet 268 is in a third position relative to retrieving mandrel means 209 in which enlarged second outside diameter 258 of lower collet retainer 248 is free to move far enough upwardly with respect to enlarged lower portion 274 of collet fingers 270 that the collet fingers will again be free to flex inwardly, in this case toward outside diameter 260, so that further upper pull on the tool string will disengage releasing collet 268 from releasing mandrel 182. Once this has occurred, the only engagement remaining between retrieving tool 200 and gravel packer 10 is the threaded engagement between left-hand threaded portion 238 of collet 230 and left-hand threaded portion 46 of top sub 28. It is then a matter of simply rotating the tool string to the right to break this threaded engagement, so that the tool string and retrieving tool 200 may be raised from well bore 300.

As hereinbefore described, pins 78, 108 and 136 in gravel packer 10 provide a means for preventing relative rotational movement of the components adjacent thereto. All of the components of gravel packer 10 are made of an easily millable material, such as ductile iron, and thus gravel packer 10 may be milled out of well bore 300, because the components in the gravel packer are prevented from relative rotational movement.

It will be seen, therefore, that the retrievable gravel packer and retrieving tool therefor of the present invention are well adapted to carry out the ends and advantages mentioned as well as those inherent therein. While a presently preferred embodiment of the invention has been described for the purposes of this disclosure, numerous changes in the arrangement and construction of parts may be made by those skilled in the art. All such changes are encompassed within the scope and spirit of the appended claims.

What is claimed is:

1. A gravel packer comprising:

packer mandrel means for connecting to an operating tool;

sealing means disposed around said packer mandrel means for sealingly engaging a well bore when in a set position;

slip means disposed around said packer mandrel means for grippingly engaging said well bore when in a set position, said slip means comprising:

a slip housing;

an upper slip wedge adjacent to said slip housing and slidably engaged with said packer mandrel means;

a lower slip wedge adjacent to said slip housing and slidable therewith; and a plurality of slips disposed in said slip housing and engagable by said upper and lower slip wedges;

sleeve means disposed around said packer mandrel means and slidable therewith for actuating said sealing means and said slip means into said set positions;

means on said packer mandrel means for engaging said upper slip wedge whereby said upper slip wedge may be moved away from said slips during a retrieving operation; and means on said upper slip wedge for engaging said slip housing during said retrieving operation after said packer mandrel means engages said upper slip wedge.

2. The apparatus of claim 1 further comprising port means through said packer mandrel means and said sleeve means for providing fluid communication between a central opening defined through said packer mandrel means and a well annulus, defined between said sleeve means and a portion of said well bore above said sealing means, regardless of the relative position of said packer mandrel means and said sleeve means.

3. The apparatus of claim 1 further comprising shearing means for shearably connecting said sleeve means to said packer mandrel means and for shearing in response to a predetermined force applied on said sleeve means from said operating tool.

4. The apparatus of claim 1 further comprising ratchet means between said packer mandrel means and said sleeve means for allowing relative downward movement of said sleeve means with respect to said packer means and preventing relative upward movement thereof prior to said retrieving operation.

5. The apparatus of claim 4 further comprising means for preventing relative rotation between said ratchet ring and said sleeve means.

6. The apparatus of claim 1 further comprising means for preventing relative rotation of said sleeve means and said slip means with respect to said packer mandrel means.

7. The apparatus of claim 1 further comprising shearing means for shearably connecting said upper slip wedge to said packer mandrel means and for shearing in response to a predetermined force applied on said packer mandrel means during said setting operation.

8. The apparatus of claim 1 further comprising:

lower mandrel means for connecting to a lower tool string portion and attached to said lower slip wedge;

collet means for connecting said packer mandrel means to said lower mandrel means; and releasing means for disengaging said collet means and releasing said packer mandrel means from said lower mandrel means.

9. The apparatus of claim 1 further comprising gauging means for gauging a size of said well bore and preventing damage to said sealing means and said slip means as said packer is lowered into said well bore.

10. A gravel packer for use in a well bore, said packer comprising:

an elongated inner mandrel assembly defining a central opening therethrough and comprising:

an upper portion having a threaded portion adapted for connection to an operating tool;

an intermediate portion having a substantially cylindrical outer surface thereon with a generally upwardly facing shoulder at a lower end of said cylindrical surface; and a lower portion;

a pusher sleeve assembly slidably disposed around said inner mandrel assembly adjacent to said upper portion thereof and said ratcheted mandrel surface, said pusher sleeve assembly comprising:

an upper portion adapted for engagement with an actuating portion of said operating tool;

an intermediate portion; and a lower portion;

an elastomeric packer element disposed around said inner mandrel assembly in sealing engagement with said cylindrical outer surface thereon, said packer element having an upper end engaged by said lower portion of said pusher sleeve assembly and a lower end;

a slip assembly comprising:

an upper slip wedge assembly slidably disposed around said inner mandrel assembly and having an upper portion engaging said lower end of said packer element, said upper slip assembly having a downwardly facing wedge surface thereon and a downwardly facing shoulder adapted for engagement by said shoulder on said intermediate portion of said inner mandrel assembly, said upper slip assembly further having a generally upwardly facing shoulder thereon;

a lower slip wedge assembly disposed below said upper slip wedge assembly and having an upwardly facing wedge surface thereon;

a slip housing disposed around said upper and lower slip wedge assemblies, said slip housing defining a slot therein, wherein said upwardly facing shoulder on said upper slip assembly extends into said slot and is adapted for engagement with an upper end of said slot; and a plurality of slips, each slip having an upper and lower wedge surface thereon engaged with said downwardly facing and upwardly facing wedge surfaces, respectively;

a lower mandrel assembly connected to said lower wedge assembly;

means for connecting said lower mandrel assembly to said lower portion of said inner mandrel assembly; and means for allowing downward movement only of said pusher sleeve assembly with respect to said inner mandrel assembly during a setting operation in response to an actuating portion of said operating tool for setting said packer element into sealing engagement with said well bore and further setting said slips into gripping engagement with said well bore.

11. The apparatus of claim 10 wherein said pusher sleeve assembly is shearably connected to said inner mandrel assembly prior to actuation of said actuating portion of said operating tool.

12. The apparatus of claim 10 wherein said upper slip wedge assembly is shearably connected to said inner mandrel assembly prior to actuation of said actuating portion of said setting tool.

13. The apparatus of claim 10 further comprising antirotation means for preventing relative rotation of said inner mandrel assembly, said pusher sleeve assembly and said slip assembly.

14. The apparatus of claim 13 wherein said antirotation means comprises:

a pin extending from one of said pusher sleeve assembly and said inner mandrel assembly into a longitudinal slot defined in the other of said pusher sleeve assembly and said inner mandrel assembly;

a pin extending from one of said upper slip wedge assembly and said inner mandrel assembly into a longitudinal slot defined in the other of said upper slip wedge assembly and said inner mandrel assembly; and a pin extending from one of said lower slip wedge assembly and said slip housing into a longitudinal slot defined in the other of said lower slip wedge assembly and said slip housing.

15. The apparatus of claim 10 wherein said means for allowing downward movement is characterized by a ratchet ring engaged with said pusher sleeve assembly and having a ratcheted inner surface thereon engaged with a ratcheted mandrel surface on said inner mandrel assembly.

16. The apparatus of claim 15 wherein:

one of said ratchet ring and said pusher sleeve assembly defines a longitudinal slot therein; and the other of said ratchet ring and said pusher sleeve assembly has a pin extending therefrom into said slot for preventing relative rotation between said ratchet ring and said pusher sleeve assembly.

17. The apparatus of claim 10 wherein:

said upper portion of said inner mandrel assembly defines a plurality of transverse ports therethrough; and said intermediate portion of said pusher sleeve assembly defines a plurality of slots therethrough, at least one of said slots being in communication with at least one of said ports.

18. The apparatus of claim 10 wherein said connecting means is a releasable connecting means comprising:

a collet attached to said lower portion of said inner mandrel assembly; and a releasing mandrel slidably disposed adjacent to said collet between first and second positions, wherein:

said collet lockingly engages said lower and inner mandrel assemblies when said releasing mandrel is in said first position; and said collet is releasable when said releasing mandrel is in said second position.

19. A gravel packing system comprising: an operating tool attachable to a tool string and having an actuating portion and a threaded portion, said operating tool defining two flow passages therein;

a packer comprising:

a mandrel having a threaded portion engaged by said threaded portion of said operating tool when said operating tool is in a setting position and defining a flow port therein in communication with one of flow passages when said operating tool is in a circulating position;

a packer element;

a slip assembly; and a pusher sleeve engaged with said actuating portion of said operating tool when said operating tool is in said setting position, said pusher sleeve being downwardly movable in response to said actuating portion for setting said packer element and said slips into engagement with a well bore;

a ported sub attached to said packer and in communication with the other of flow passages in said operating tool; and a screen assembly attached to said ported sub.

20. The system of claim 19 wherein said packer comprises anti-rotation means for preventing relative rotation of said mandrel, pusher sleeve and slip assembly.

* * * * *

UNITED STATES PATENT AND TRADEMARK OFFICE

CERTIFICATE OF CORRECTION

PATENT NO. : 4,842,057

DATED : June 27, 1989

INVENTOR(S) : Eric P. Lubitz

It is certified that error appears in the above-identified patent and that said Letters Patent is hereby corrected as shown below:

In column 1, line 52, delete the word [inveniion] and insert therefore --invention--.

Signed and Sealed this

Third Day of April, 1990

*Attest:*

HARRY F. MANBECK, JR.

*Attesting Officer*

*Commissioner of Patents and Trademarks*